US008690152B2

(12) United States Patent
Ito et al.

(10) Patent No.: US 8,690,152 B2
(45) Date of Patent: Apr. 8, 2014

(54) SHEET CONVEYOR, IMAGE FORMING APPARATUS AND IMAGE SCANNING APPARATUS

(75) Inventors: Takayuki Ito, Nagoya (JP); Shigeru Tashiro, Toyokawa (JP); Naotoshi Kawai, Toyokawa (JP); Hiroaki Umemoto, Neyagawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/305,923

(22) Filed: Nov. 29, 2011

(65) Prior Publication Data

US 2012/0153566 A1 Jun. 21, 2012

(30) Foreign Application Priority Data

Dec. 15, 2010 (JP) ..... 2010-278733

(51) Int. Cl.
*B65H 9/04* (2006.01)

(52) U.S. Cl.
USPC ..... 271/242; 271/258.01

(58) Field of Classification Search
USPC ..... 271/226, 227, 228, 258.01, 265.01, 271/242, 245, 246, 247, 270
See application file for complete search history.

(56) References Cited

U.S. PATENT DOCUMENTS 6,397,035 B2 * 5/2002 Kataoka et al. ..... 399/388
7,354,038 B2 * 4/2008 Watase ..... 271/10.13
7,425,001 B2 * 9/2008 Sano et al. ..... 271/242

FOREIGN PATENT DOCUMENTS

JP 2005-154119 A 6/2005
JP 2009-083948 A 4/2009

OTHER PUBLICATIONS

Office Action (Notification of Reasons for Refusal) dated Oct. 23, 2012, issued by the Japanese Patent Office in the corresponding Japanese Patent Application No. 2010-278733 and an English translation thereof. (7 pages).

* cited by examiner

*Primary Examiner* — Thomas Morrison
(74) *Attorney, Agent, or Firm* — Buchanan Ingersoll & Rooney PC

(57) ABSTRACT

When a sheet is transported as passed through a first roller pair equipped with a torque limiter and through a second roller pair, a loop formed in the sheet between the first roller pair and the second roller pair is cleared by a method wherein the amount of sheet loop is decreased by driving the second roller pair and disabling the first roller pair and wherein at the time when the sheet loop is decreased to a predetermined amount, a velocity of clearing the loop is lowered by rotating the first roller pair at a lower peripheral velocity than that of the second roller pair.

6 Claims, 8 Drawing Sheets

SHEET CONVEYOR, IMAGE FORMING APPARATUS AND IMAGE SCANNING APPARATUS

RELATED APPLICATION

The priority application number Japanese Patent Application 2010-278733 upon which this application is based is hereby incorporated by reference.

BACKGROUND OF THE INVENTION

1. Field of the Invention

The present invention relates to a sheet conveyor for sheet conveyance. More particularly, the invention is directed to reducing noise produced in conjunction with clearance of loop formed in a sheet on a sheet conveyance path.

2. Description of the Related Arts

Copiers and printers, for example, are equipped with a paper feeding station for feeding sheets stacked on a paper feed cassette into an apparatus. The paper feeding station includes a pickup roller for picking up a top sheet of those stacked on the paper feed cassette, a paper feed roller for introducing the picked sheet from the paper feed cassette into the sheet conveyance path, and a separation roller disposed in opposed relation to the paper feed roller and preventing two or more overlapped sheets from being transported.

The separation roller is provided with a torque limiter on a rotary shaft thereof. When a rotational force exceeding a torque limit of the torque limiter is applied to the separation roller, the separation roller is brought into rotation.

It is noted here that the torque limit of the torque limiter is defined to be greater than a sheet-to-sheet friction force and to be smaller than a friction force between the sheet and the separation roller. That is, the torque limiter is adapted to prevent two or more sheets from being transported by the paper feed roller.

On the sheet conveyance path, a conveyance roller pair is disposed downstream of a paper feed/separation roller pair in a sheet conveyance direction. The paper feed/separation roller pair consists of the paper feed roller and the separation roller. The conveyance roller pair is rotated at a lower peripheral velocity than that of the paper feed/separation roller pair such that the sheet being transported is prevented from being stretched between these roller pairs. With such a difference in velocity, the paper feed/separation roller pair and the conveyance roller pair allow the formation of the loop in the sheet therebetween.

However, it is difficult to spare a substantial space for the loop formation on the sheet conveyance path. In addition, there is a ceiling to the increase of the loop size. Therefore, an arrangement is made such that the driven rotation of the paper feed roller is suspended when the loop reaches a given size.

FIG. 1 is a graph showing the change in peripheral velocities of the paper feed roller and the conveyance roller pair and the change in amount of loop formed in the sheet. This graph shows the change in the peripheral velocity A1 of the paper feed roller, the change in the peripheral velocity B1 of the conveyance roller pair and the change in the amount C1 of sheet loop.

The paper feed roller and the conveyance roller pair are actuated simultaneously. When a predetermined amount of loop is formed in the sheet, or after the lapse of a predetermined length of time from the entry of a leading end of the sheet into the conveyance roller pair, control is provided to suspend the rotation of the paper feed roller. After this suspension of rotation, however, the conveyance roller pair continues to rotate and hence, the sheet is quickly decreased in the amount of loop.

It is noted here that the torque limiter of the separation roller provides resistance against the sheet conveyance and hence, the sheet is stretched taut when cleared of the loop, thus producing a loud noise. It is known that the noise increases with the increase in velocity of clearing the loop (velocity at which the loop in the sheet is decreased in a direction perpendicular to a sheet surface).

According to an image forming apparatus disclosed in a patent document 1 (Japanese Unexamined Patent Publication No. 2005-154119), the following method is adopted to prevent the sheet from being slammed against a guide. In secondary sheet conveyance following the formation of loop in the sheet, a paper stop roller pair is driven in advance of the conveyance roller pair and drive units for driving the paper stop roller pair and the conveyance roller pair are so controlled as to vary stepwise the driving speeds for these roller pairs.

The image forming apparatus of the above patent document 1, however, is designed to increase the rotational speed of the paper stop roller pair stepwise and hence, the apparatus suffers a low startup speed of sheet conveyance by the paper stop roller pair, resulting in decrease in image formation efficiency. Therefore, the same problems such as the decrease in image formation efficiency may also occur in a case where the technique of the patent document 1 is applied to the sheet feeding station including the separation roller equipped with the torque limiter.

SUMMARY OF THE INVENTION

A sheet conveyor according to the invention comprises: a first roller pair including a roller to which a torque limit of a torque limiter is imparted; a second roller pair disposed downstream of the first roller pair in a sheet conveyance direction; a drive control unit switching among a first drive mode wherein the first roller pair is rotated at a higher peripheral velocity than a peripheral velocity of the second roller pair, a second drive mode wherein the second roller pair is kept rotating whereas the first roller pair is not driven, and a third drive mode wherein the first roller pair is rotated at a lower peripheral velocity than a peripheral velocity of the second roller pair; and a loop control unit providing a first control to cause the drive control unit to select the first drive mode to allow the sheet to form a loop between the first roller pair and the second roller pair, a second control to cause the drive control unit to select the second drive mode to decrease the loop, and a third control to cause the drive control unit to select the third drive mode after the loop reaching a predetermined amount, to lower a velocity of clearing the loop from a velocity of clearing the loop of the second control.

An image forming apparatus according to the invention comprises the above sheet conveyor.

An image scanning apparatus according to the invention comprises the above sheet conveyor.

These and other objects, advantages and features of the invention will become apparent from the following description thereof taken in conjunction with the accompanying drawings which illustrate specific embodiment of the invention.

DESCRIPTION OF THE PREFERRED EMBODIMENTS

A sheet conveyor, an image forming apparatus and an image scanning apparatus according to embodiments of the invention are specifically described with reference to the accompanying drawings. It is to be noted that the sheet conveyor, image forming apparatus and image scanning apparatus according to the invention are not limited to the following embodiments.

Figure 1:
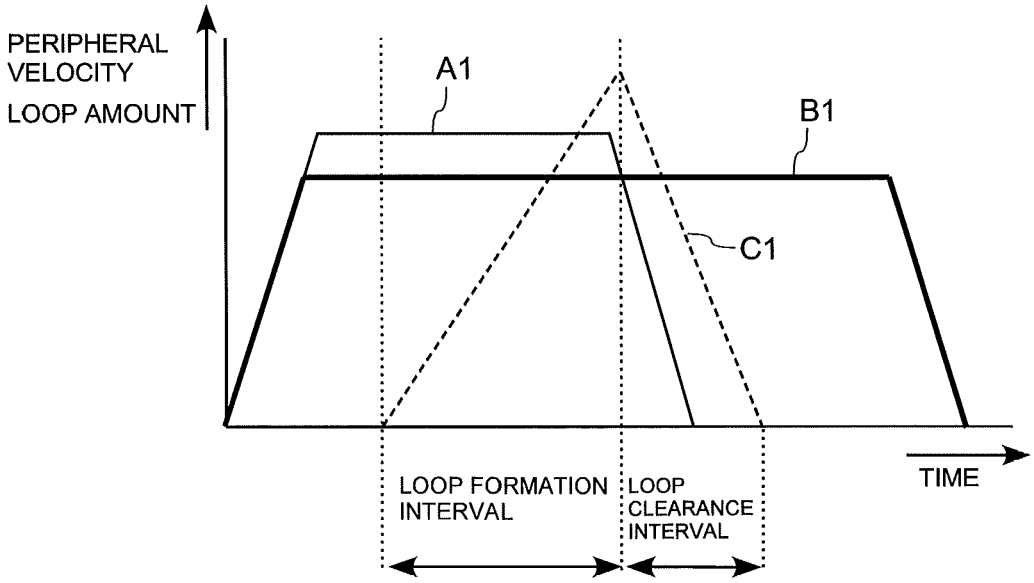
FIG. 1 illustrates a prior art technology, showing a graphical representation of the change in peripheral velocities of a paper feed roller and a conveyance roller pair and the change in amount of loop formed in a sheet.
Figure 2:
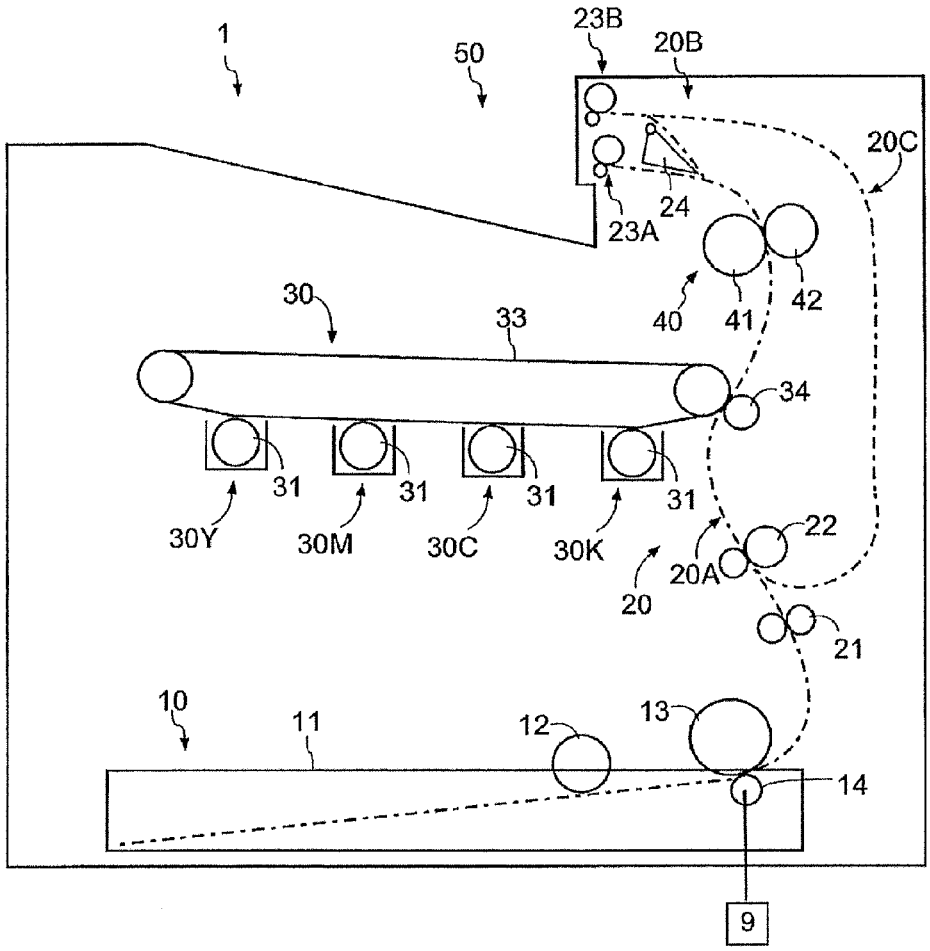
FIG. 2 is a diagram showing a mechanical configuration of an image forming apparatus equipped with a sheet conveyor according to one embodiment of the invention.

FIG. 2 illustrates an image forming apparatus equipped with the sheet conveyor of the embodiment.

This image forming apparatus is, for example, a printer which forms an image on a sheet based on imagery data or text data externally inputted thereto via a network or the like. The image forming apparatus includes a sheet feeding station 10, a sheet conveyance path 20, an image forming station 30, a fixing station 40, a sheet discharger 50 and the like which are housed in a main body of the apparatus 1.

The sheet feeding station 10 includes a paper feed tray 11, a pickup roller 12, a paper feed roller 13, a separation roller 14 and the like. When the pickup roller 12 rotates, a top sheet of those stacked on the paper feed cassette 11 is fed into a pair of rollers consisting of the paper feed roller 13 and the separation roller 14.

A torque limiter 9 is mounted on a rotary shaft of the separation roller 14. A torque limit of the torque limiter is defined to be greater than a sheet-to-sheet friction force and to be smaller than a friction force between the sheet and the separation roller 14.

Accordingly, when one sheet is fed into space between the paper feed roller 13 and the separation roller 14, a friction force between this sheet and the separation roller 14 exceeds the torque limit of the torque limiter. Hence, the separation roller 14 is rotated following the paper feed roller to transport the one sheet. When two or more sheets are fed into the space between the paper feed roller 13 and the separation roller 14, on the other hand, the sheet-to-sheet friction force is below the toque limit so that the separation roller is not driven to rotate. Hence, only the sheet in contact with the above paper feed roller 13 is transported by this paper feed roller.

The sheet conveyance path 20 includes: an image formation path 20A, a sheet discharge/reversal path 20B, a double-sided sheet conveyance path 20C, and a variety of rollers disposed on these paths.

The image formation path 20A is provided with a conveyance roller pair 21, a paper stop roller pair 22, a secondary transfer roller 34, the fixing station 40 and the like. A sheet taken out by the paper feed roller 13 is transported through the conveyance roller pair 21 disposed downstream of the paper feed roller and is temporarily stopped at the paper stop roller pair 22. As timed with an image forming operation, the sheet is transported by the paper stop roller pair 22.

The sheet discharge/reversal path 20B is provided with a sheet discharge roller 23A and a reverse roller 23B. In the case of simplex printing, a sheet through the image formation path 20A is guided into the sheet discharge/reversal path 20B where the sheet is discharged by rotating the sheet discharge roller 23A in a forward direction. In the case of duplex printing, on the other hand, a sheet printed on one side, which has been passed through the image formation path 20A, is guided to the reverse roller 23B by a switching claw 24. The reverse roller 23B is rotated in the forward direction and then in the opposite direction whereby the sheet, the trailing end of which is in turn a leading end, is introduced into the double-sided sheet conveyance path 20C.

The image forming station 30 includes: a yellow image forming unit 30Y, a magenta image forming unit 30M, a cyan image forming unit 30C, a black image forming unit 30K, an intermediate transfer belt 33 and the secondary transfer roller 34. The above image forming unit 30Y, for example, includes a photosensitive drum 31 as well as a charger device, an exposure device, a developing device, a primary transfer roller and a cleaning device which are disposed around the photosensitive drum and are not shown in the figure. The image forming units 30M, 30C, 30K of the other colors are constructed the same way as the above image forming unit 30Y.

Toner images formed on the photosensitive drums 31 of the image forming units 30Y, 30M, 30C, 30K of the respective colors are primarily transferred to the intermediate transfer belt in turn so that a full-color toner image is formed on the intermediate transfer belt 33. When a sheet is passed between the intermediate transfer belt 33 and the secondary transfer roller 34, the toner image on the intermediate transfer belt 33 is transferred to one side of the sheet.

The fixing station 40 includes a fusing roller 41 having a heat source, and a pressure roller 42 in contact with this fusing roller 41. These rollers 41, 42 apply pressure and heat to the sheet carrying the toner image thereon and passed between these rollers, thereby fixing the transferred toner image to the sheet. The sheets gone through this fixing operation are sequentially stacked on the sheet discharger 50.

Figure 3:
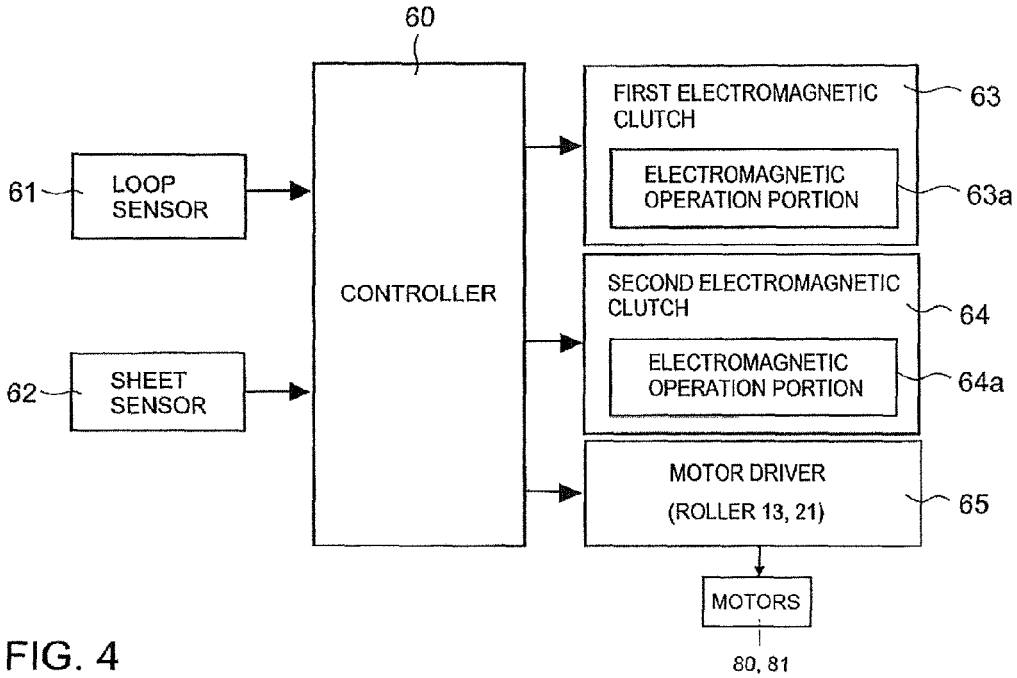
FIG. 3 is a block diagram schematically showing a sheet conveyance control system of the image forming apparatus shown in FIG. 2.

FIG. 3 is a block diagram schematically showing a sheet conveyance control system of the image forming apparatus shown in FIG. 2.

A controller 60 composed of a microcomputer and the like includes, but not shown, a CPU; memories (ROM, RAM, EEPROM and the like) for storing a program for operating the CPU and a variety of information items; I/O (Input/Output) interfaces for connecting a variety of sensors, motors, electromagnetic operation portions of electromagnetic clutches and the like to the CPU; and the like.

As shown in FIG. 3, the above controller 60 is connected with a loop sensor 61 for detecting an amount of loop formed in the sheet, a sheet sensor 62 for detecting the leading end of the sheet delivered to the conveyance roller pair 21, an electromagnetic operation portion 63*a* of a first electromagnetic clutch 63, an electromagnetic operation portion 64*a* of a second electromagnetic clutch 64, a motor driver 65 and the like. The motor driver 65 drives motors 80, 81 illustrated in FIG. 3, so as to apply rotational driving force to the paper feed roller 13 and the conveyance roller pair 21.

Figure 4:
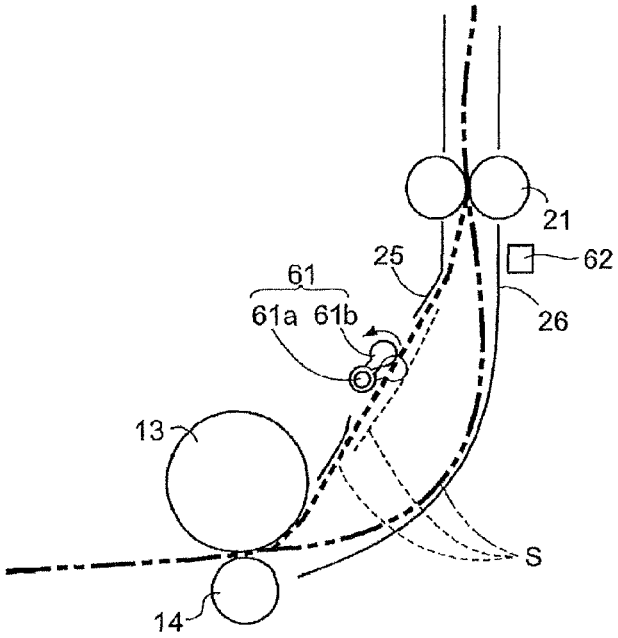
FIG. 4 is a diagram showing, in enlarged dimension, a mechanical configuration of an area where the paper feed roller, a separation roller and the conveyance roller pair of the image forming apparatus of FIG. 2 are disposed.

As shown in FIG. 4, the loop sensor 61 is disposed above a curved sheet conveyance portion extended from the paper feed roller 13 to the conveyance roller pair 21.

The sheet conveyance portion includes an inner guide plate 25 and an outer guide plate 26. A sheet S passed between the paper feed roller 13 and the separation roller 14 is transported in a manner to bulge toward the outer guide plate 26. It is noted that one sheet S is shown in FIG. 4 where a chain double-dashed line represents the sheet forming a loop, a fine dotted line represents the sheet having the loop decreased to a predetermined amount, and the thick dotted line represents the sheet cleared of the loop.

The loop sensor 61 includes a rotary shaft 61*a*, a sensing member 61*b* eccentrically mounted on the rotary shaft 61*a*, and first and second switches (not shown) actuated according to the change in oscillation angle of the rotary shaft 61*a*.

The sensing member 61*b* is disposed in a manner to project from the inner guide plate 25 into the sheet conveyance portion. When the sensing member 61*b* is pushed by the sheet S progressively cleared of the loop, the sensing member 61*b* and the rotary shaft 61*a* are turned counterclockwise to actuate the first and second switches in turn. More specifically, the first switch is actuated by the rotary shaft 61*a* turned through an oscillation angle as pushed by the sheet S having the loop decreased to a predetermined amount. The second switch is actuated by the rotary shaft 61*a* turned through an oscillation angle as pushed by the sheet S cleared of the loop. The rotary shaft 61*a* is equipped with an unillustrated return spring such that when free from the pressure by the sheet S, the rotary shaft 61*a* is spring-urged into oscillation by the return spring, projecting the sensing member 61*b* into the sheet conveyance portion.

The above-described sheet sensor 62 is also disposed at the sheet conveyance portion. When the sheet sensor 62 detects a leading end of the sheet S, the controller 60 starts a timer and suspends the rotation of the paper feed roller 13 after the lapse of a predetermined length of time. Even after the rotation of the paper feed roller 13 is suspended, the conveyance roller pair 21 continues to rotate to advance the leading end of the sheet S. After the rotation suspension of the paper feed roller 13, therefore, the sheet is quickly reduced in the amount of loop.

Figure 5:
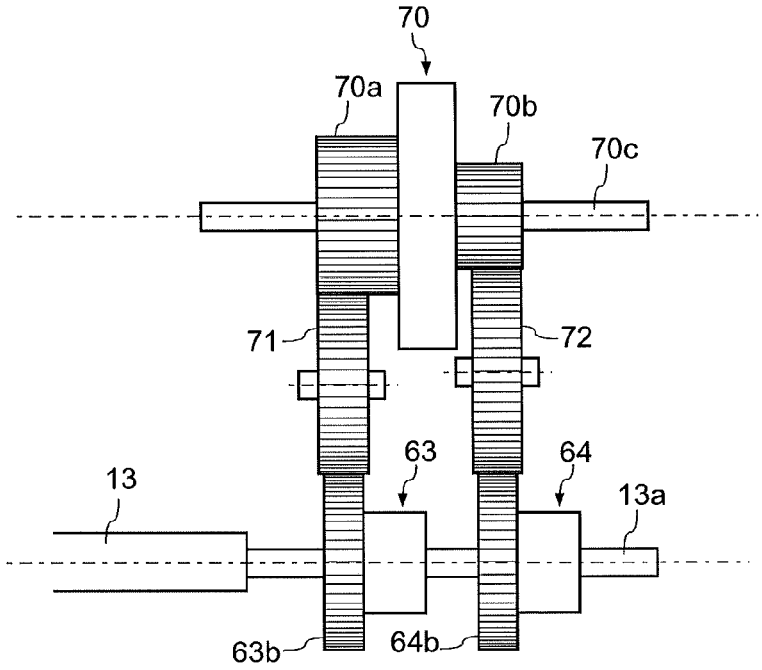
FIG. 5 is a diagram illustrating a driving force transmission mechanism for the sheet conveyor of the image forming apparatus shown in FIG. 2.

As shown in FIG. 5, the first electromagnetic clutch 63 and the second electromagnetic clutch 64 are mounted on a rotary shaft 13*a* of the paper feed roller 13.

The controller 60 controls the energization of the electromagnetic operation portions 63*a*, 64*a* thereby switching the first and second electromagnetic clutches 63, 64 between a torque transmission mode wherein the gear 63*b*, 64*b* of the first or second electromagnetic clutch 63, 64 is allowed to transmit the torque to the rotary shaft 13*a* and a no torque transmission mode wherein the gear 63*b*, 64*b* is allowed to idle relative to the rotary shaft 13*a*. The gears 63*b*, 64*b* have the same diameter. The first electromagnetic clutch 63 and the second electromagnetic clutch 64 employ the gears of the same specification. The gear 63*b* is meshed with a large diameter gear 70*a* of a triple gear 70 via an intermediate gear 71 having a smaller diameter than the other intermediate gear, which comprise a first transmission mechanism. The gear 64*b* is meshed with a small diameter gear 70*b* of the triple gear 70 via the intermediate gear 72 having the large diameter, which comprise a second transmission mechanism. A driving shaft 70*c* of the triple gear 70 is connected with a motor 80 driven by the motor driver 65.

A rotational driving force of the driving shaft 70*c* is transmitted to the above-described first electromagnetic clutch 63 and second electromagnetic clutch 64, respectively. The rotational driving force is transmitted by means of the gears 70*a*, 70*b* of the triple gear 70 that have the different diameters, as described above. Therefore, a rotational velocity (hereinafter, referred to as "second rotational velocity") of the paper feed roller 13 driven via the second electromagnetic clutch 64 in the torque transmission mode is lower than a rotational velocity (hereinafter, referred to as "first rotational velocity") of the paper feed roller 13 driven via the first electromagnetic clutch 63 in the torque transmission mode.

A peripheral velocity of the paper feed roller 13 driven at the first rotational velocity is higher than a peripheral velocity of the conveyance roller pair 21 so that the sheet S transported at the first rotational velocity is increased in the amount of loop. On the other hand, a peripheral velocity of the paper feed roller 13 driven at the second rotational velocity is lower than the peripheral velocity of the conveyance roller pair 21 so that the sheet S transported at the second rotational velocity is decreased in the amount of loop. When both the first electromagnetic clutch 63 and the second electromagnetic clutch 64 are placed in the no torque transmission mode, the rotation of the paper feed roller 13 is suspended. In this state, therefore, the loop in the sheet S is quickly decreased.

Figure 6:
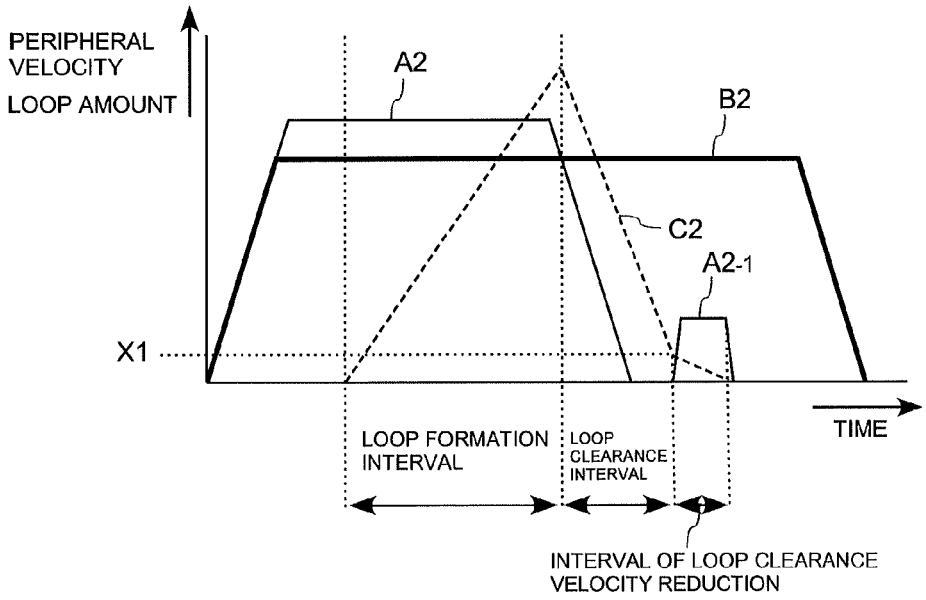
FIG. 6 illustrates an example of control of the peripheral velocity of the paper feed roller in the sheet conveyor of the image forming apparatus shown in FIG. 2, showing a graphical representation of a relation between the change in the peripheral velocities of the paper feed roller and the conveyance roller pair and the change in the amount of loop formed in the sheet.

FIG. 6 is a graph showing the change in peripheral velocities of the paper feed roller 13 and the conveyance roller pair 21 and the change in the amount of loop formed in the sheet. This graph shows the change in the peripheral velocities A2 and A2-1 of the paper feed roller 13, the change in the peripheral velocity B2 of the conveyance roller pair 21 and the change in the amount C2 of sheet loop.

Description is made with reference to this graph. When the first electromagnetic clutch 63 is switched from the torque transmission mode (the first rotational velocity mode) to the no torque transmission mode, the rotation of the paper feed roller 13 is suspended, whereas the conveyance roller pair 21 continues to rotate afterward. Accordingly, the sheet is quickly decreased in the amount of loop.

When the sheet with the loop decreased to a predetermined amount X1 turns on the first switch of the loop sensor 61, the controller 60 receives an on signal and controls the electromagnetic operation portion 64*a* to switch the second electromagnetic clutch 64 to the torque transmission mode. Thus, the paper feed roller 13 is rotated at the second rotational velocity, establishing a state where a loop clearance velocity is lowered. When the sheet with the loop decreased to zero turns on the second switch of the loop sensor 61, the controller 60 receives an on signal and controls the electromagnetic operation portion 64*a* to switch the second electromagnetic clutch 64 to the no torque transmission mode. Thus, the rotation of the paper feed roller 13 is suspended.

Figure 7:
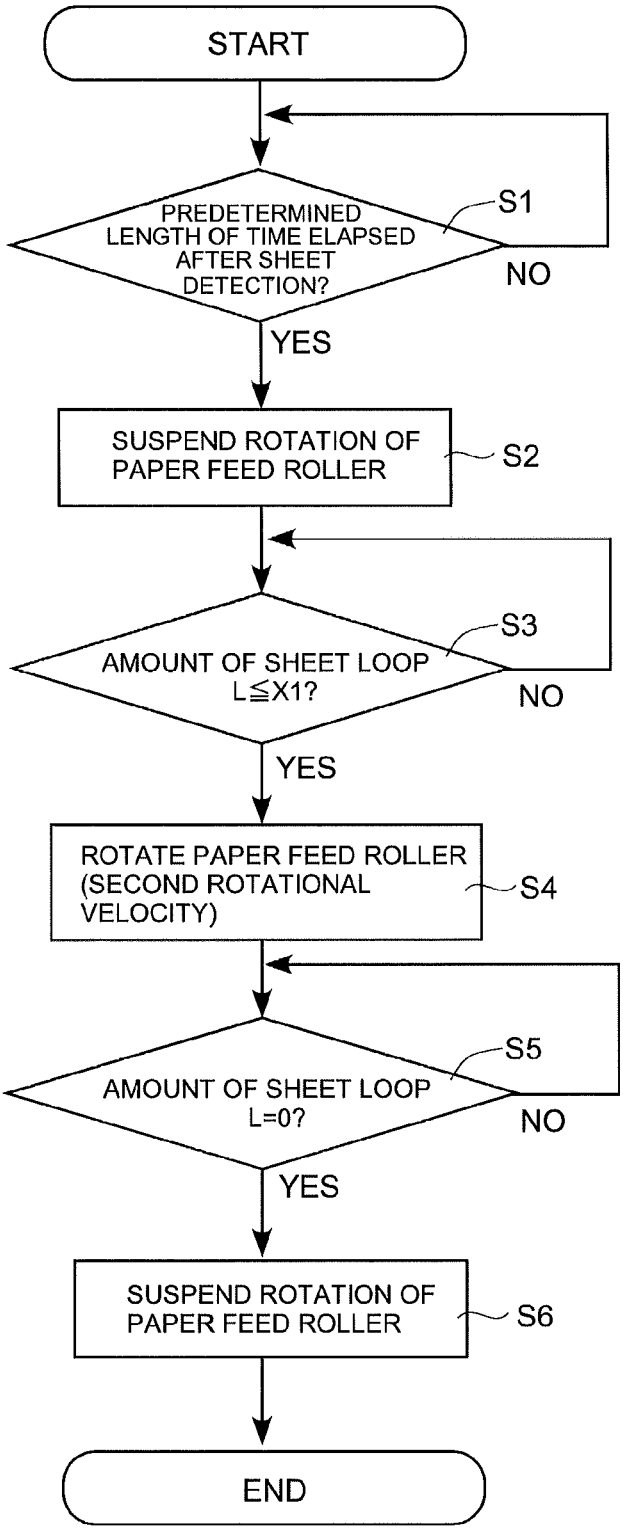
FIG. 7 is a flow chart showing the steps of a control operation for loop clearance based on the change in the amount of loop shown in FIG. 6.

FIG. 7 is a flow chart showing the steps of an operation performed by the controller 60. The flow chart shows how the controller controls the rotation of the paper feed roller 13 (the control of loop formation and loop clearance velocity) after the sheet is fed into the apparatus by rotating the paper feed roller 13 at the first rotational velocity.

The controller 60 determines whether or not a predetermined length of time has elapsed after an output from the sheet sensor 62 detecting the leading end of the sheet delivered to be placed near the conveyance roller pair 21 (Step S1).

If the predetermined length of time has elapsed, the controller 60 suspends the rotation of the paper feed roller 13 (Step S2). Subsequently, the controller determines whether an amount of sheet loop L is L≤X1 or not (Step S3). If the amount of sheet loop L is not L≤X1, the control operation returns to Step S3. If L≤X1, namely turn-on of the first switch of the loop sensor 61 is detected, the controller rotates the paper feed roller 13 at the second rotational velocity (Step S4).

Next, the controller determines whether the amount of sheet loop L is L=0 or not (Step S5). If not L=0, the control operation returns to Step S5. If L=0, the controller suspends the rotation of the paper feed roller 13 (Step S6) and terminates the operation.

Under the above control, the velocity of clearing the sheet loop is lowered and the driven rotation of the paper feed roller 13 is suspended at the time when the sheet is cleared of the loop.

In a case where the sheet has its trailing end interposed between the paper feed roller 13 and the separation roller 14 at the time when the driven rotation of the paper feed roller 13 is suspended, the sheet is stretched taut because the torque limiter of the separation roller 14 resists against the conveyance of the sheet. However, the sheet is already cleared of the loop as described above and hence, noise is not produced by stopping the rotation of the paper feed roller 13.

When the image forming operation for the subsequent sheet is started following Step S6 to suspend the rotation of the paper feed roller 13, the paper feed roller 13 is driven again into rotation at the first rotational velocity.

Figure 8:
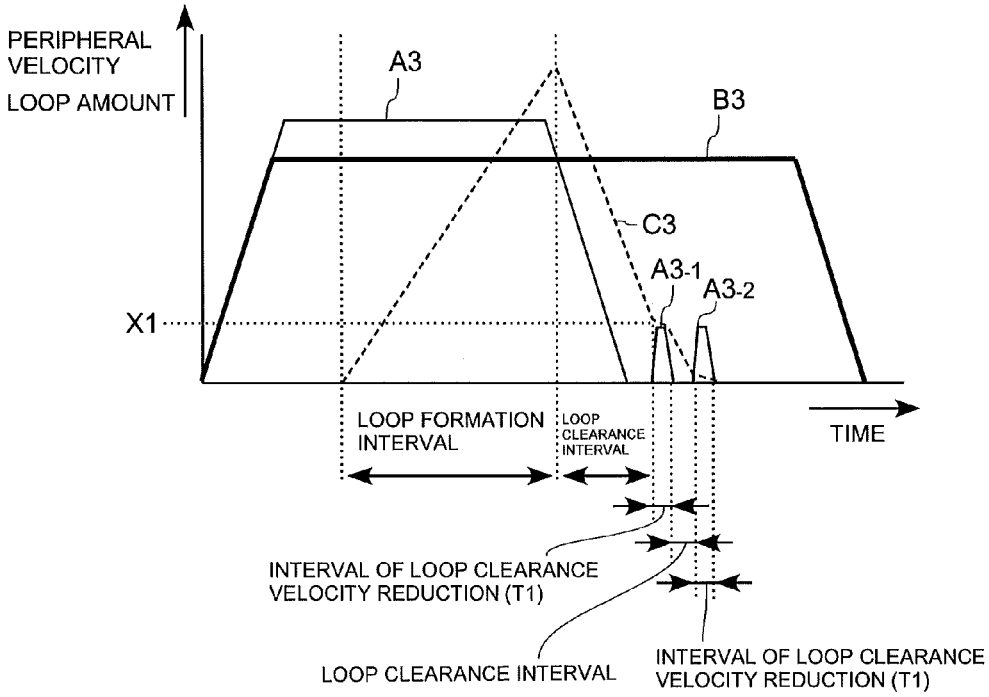
FIG. 8 illustrates an example of control of the peripheral velocity of the paper feed roller in the sheet conveyor of the image forming apparatus shown in FIG. 2, showing a graphical representation of a relation between the change in the peripheral velocities of the paper feed roller and the conveyance roller pair and the change in the amount of loop formed in the sheet.
Figure 9:
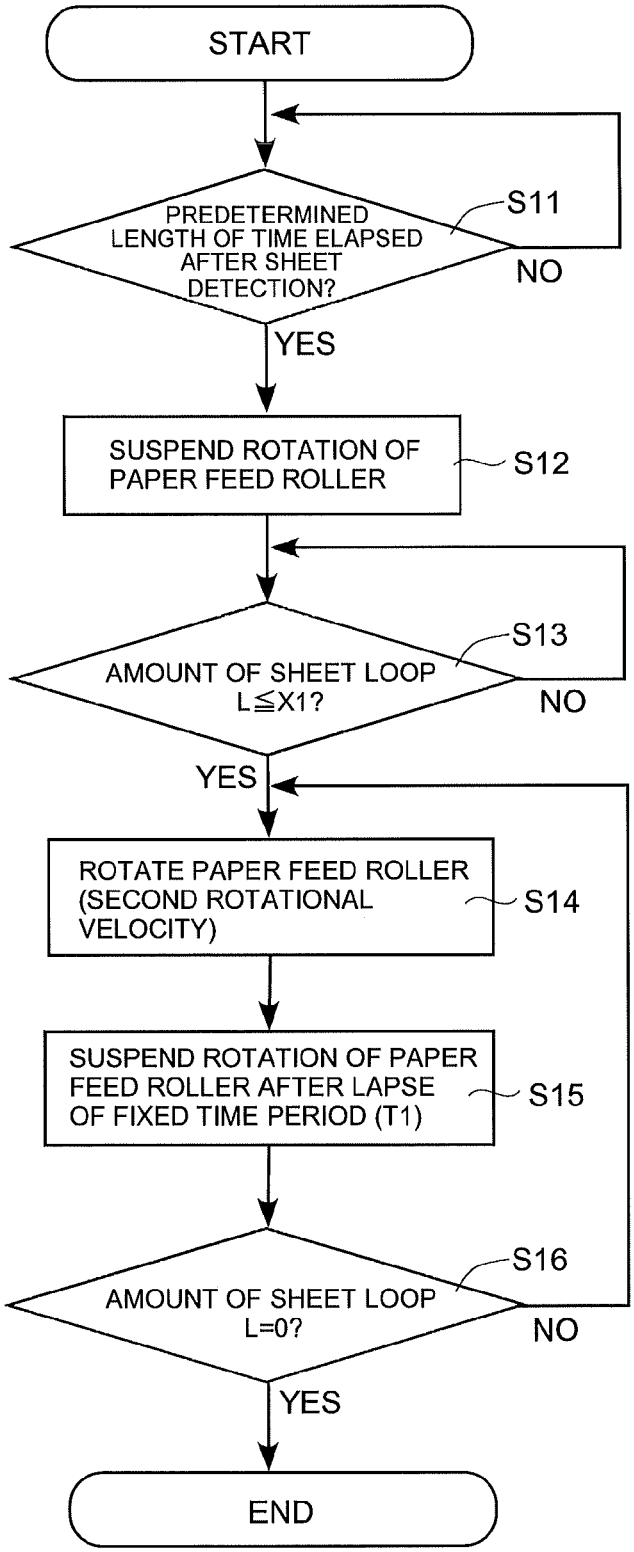
FIG. 9 is a flow chart showing the steps of a control operation for loop clearance based on the change in the amount of loop shown in FIG. 8.

Next, description is made on another example of the loop clearance control with reference to FIG. 8 and FIG. 9.

FIG. 8 is a graph showing the change in the peripheral velocities of the paper feed roller 13 and the conveyance roller pair 21 and the change in the amount of loop formed in the sheet. This graph shows the change in the peripheral velocities A3, A3-1 and A3-2 of the paper feed roller 13, the change in the peripheral velocity B3 of the conveyance roller pair 21 and the change in the amount C3 of sheet loop.

Referring to the graph, when the sheet with the loop decreased to the predetermined amount X1 turns on the first switch of the loop sensor 61 in the process of quickly decreasing the amount of sheet loop by suspending the rotation of the paper feed roller 13, the controller 60 receives the on signal and controls the electromagnetic operation portion 64*a* to operate the second electromagnetic clutch 64 in the torque transmission mode for a fixed period of time (T1). Thus, the paper feed roller 13 is rotated at the second rotational velocity for the fixed period of time (T1), establishing a state where the loop clearance velocity is lowered. The controller 60 repeats the above fixed-time (T1) operation to lower the loop clearance velocity till the sheet cleared of the loop turns on the second switch of the loop sensor 61. It is noted that the predetermined amount X1 shown in FIG. 8 may be different from the predetermined amount X1 shown in FIG. 6. A loop clearance interval between the peripheral velocity changes A3-1 and A3-2 can be practically set to nearly zero.

FIG. 9 is a flow chart showing the steps of an operation corresponding to FIG. 8 and performed by the controller 60. The flow chart shows how the controller controls the rotation of the paper feed roller 13 (the control of loop formation and loop clearance velocity) after the sheet is fed into the apparatus by rotating the paper feed roller 13 at the first rotational velocity.

The controller 60 determines whether or not a predetermined length of time has elapsed after an output from the sheet sensor 62 detecting the leading end of the sheet delivered to the conveyance roller pair 21 (Step S11).

If the predetermined length of time has elapsed, the controller 60 suspends the rotation of the paper feed roller (Step S12). Next, the controller determines whether an amount of sheet loop L is L≤X1 or not (Step S13). If the amount of sheet loop L is not L≤X1, the control operation returns to Step S13. If L≤X1, namely turn-on of the first switch of the loop sensor 61 is detected, the controller rotates the paper feed roller 13 at the second rotational velocity (Step S14). After the lapse of the fixed period of time (T1), the controller suspends the rotation of the paper feed roller 13 (Step S15).

Subsequently, the controller determines whether the amount L of sheet loop is L=0 or not (Step S16). If not L=0, the control operation returns to Step S14 to rotate the paper feed roller 13 for the fixed period of time (T1). If L=0, the controller terminates the operation.

In this manner, the controller may also perform the control operation wherein after the amount of sheet loop L reaches LX1, the step to rotate the paper feed roller 13 for the fixed period of time (T1) and the step to determine whether the amount of sheet loop is zero or not are repeated till the amount of sheet loop is decreased to zero.

The amount of sheet loop is determined using the mechanically operable loop sensor 61. Alternatively, the amount of sheet loop may also be determined by, for example, detecting a distance from the inner guide plate 25 to a central part (loop apex) of the sheet by means of an optical detector or the like.

The sensor adapted to detect the loop clearance based on actual measurement may preferably be disposed at such a place as to allow the sensor to make contact with the sheet when the sheet is cleared of the loop. Further, the amount of loop may also be estimated instead of detecting the actual amount of sheet loop. If a velocity at which the loop is formed by the roller operated at the first rotational velocity and a velocity at which the loop is cleared by the roller operated at the second rotational velocity are known, the amount of loop can be estimated based on time elapsed after driving the paper feed roller 13 into rotation or after detecting the sheet by a sensor for detecting a sheet jam or sheet passage.

In the case where the paper feed roller with the sheet loop decreased to the predetermined amount is rotated at the second rotational velocity, if time taken to decrease the loop to zero is known, it is also possible to estimate the sheet loop to be zero by measuring the elapsed time. An error between the estimated amount of loop and the measured amount of loop may appear or a sheet clearance path may change depending upon a sheet type. Therefore, it is preferred to detect the amount of loop by taking measurement if such a trouble is anticipated. In the operation shown in FIG. 8 and FIG. 9, it is desirable to detect the amount of loop by taking measurement because the error of estimated amount of loop increases with repetition of on/off switching of the rotation of the paper feed roller.

While the above description illustrates the example where the sheet conveyor is applied to the sheet feeding station 10 of the image forming apparatus, the sheet conveyor may also be applied to an image scanning apparatus.

Figure 10:
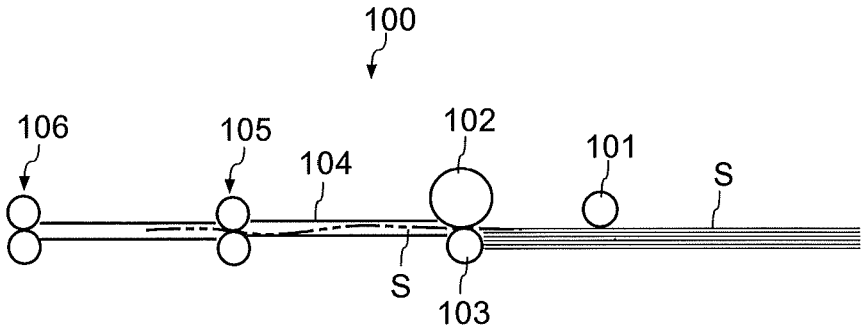
FIG. 10 is a diagram showing a mechanical configuration of an image scanning apparatus incorporating a sheet conveyor according to an embodiment of the invention.

FIG. 10 shows a sheet conveyor of an image scanning apparatus 100. In this sheet conveyor, a pickup roller 101 is rotated to feed a top sheet (document) of those stacked on a document feed tray into space between a paper feed roller 102 and a separation roller 103. A torque limiter (not shown) is mounted on a rotary shaft of the separation roller 103.

The torque limiter operates as follows. Even if two or more sheets S are fed into the space between the paper feed roller 102 and the separation roller 103, the sheet-to-sheet friction force is below the toque limit of the torque limiter so that the separation roller is not driven into rotation. Hence, only the sheet in contact with the above paper feed roller 102 is transported by the paper feed roller 102.

The sheet S forms a loop in a sheet conveyance path 104 between the paper feed roller 102 and a conveyance roller pair 105. An amount of the loop is estimated based on a time elapsed after detection of the sheet S by an unillustrated sensor for detecting sheet jam or sheet passage.

A pair of paper stop rollers 106 is disposed downstream of the conveyance roller pair 105. An optical image scanning portion (not shown) is disposed downstream of the paper stop roller pair 106.

In the above image scanning apparatus 100 as well, a loop clearing noise is produced when the sheet S is cleared of the loop. However, the loop clearance velocity may be lowered by controlling the rotation of the paper feed roller 102 based on the amount of loop formed in the sheet S, whereby the loop clearing noise can be reduced.

The sheet conveyor of the invention operates as follows to clear the loop formed in the sheet between a first roller pair and a second roller pair. The sheet conveyor provides a second control to decrease the loop by placing the roller pairs in a second drive mode wherein the second roller pair is kept rotating whereas the first roller pair is not driven. After the loop is decreased to the predetermined amount, the sheet conveyor provides a third control to lower the loop clearance velocity from that of the second control by placing the roller pairs in a third drive mode wherein the first roller pair is rotated at a lower peripheral velocity than that of the second roller pair. Thus, the loop clearing noise can be reduced according to the decrease in the loop clearance velocity.

In the above-described third control, the reduction of the loop clearance velocity is accomplished by controlling the peripheral velocity of the first roller pair without lowering the peripheral velocity of the second roller pair. Therefore, the sheet conveyor does not suffer the decrease in steel: conveyance efficiency which depends upon the peripheral velocity of the second roller pair.

In the sheet conveyor of the invention, therefore, the noise associated with the loop clearance operation can be reduced because the loop clearance velocity is lowered when the sheet is cleared of the loop formed therein. Furthermore, the sheet conveyor is not decreased in the sheet conveyance efficiency because the reduction of the loop clearance velocity does not involve the reduction of the peripheral velocity of the second roller pair.

Although the present invention has been fully described by way of examples, it is to be noted that various changes and modifications will be apparent to those skilled in the art.

Therefore, unless otherwise such changes and modifications depart from the scope of the present invention, they should be construed as being included therein.

The invention claimed is:

1. A sheet conveyor comprising:

a first roller pair including a roller to which a torque limit of a torque limiter is imparted;

a second roller pair disposed downstream of the first roller pair in a sheet conveyance direction;

a drive shaft;

motors that drive the drive shaft and the second roller pair;

first and second electromagnetic clutches configured to be selectively engaged to couple the drive shaft to the first roller pair and selectively transmit torque to rotate the first roller pair;

a processor causing, in a first drive mode, the first roller pair to be coupled to the drive shaft through a first transmission mechanism using the first electromagnetic clutch so as to rotate at a higher peripheral velocity than a peripheral velocity of the second roller pair, in a second drive mode, the second roller pair is kept rotating whereas the first roller pair is not driven, and in a third drive mode, the first roller pair is coupled to the drive shaft through a second transmission mechanism using the second electromagnetic clutch so as to rotate at a lower peripheral velocity than a peripheral velocity of the second roller pair;

the processor providing a first control to select the first drive mode to allow the sheet to form a loop between the first roller pair and the second roller pair, a second control to select the second drive mode to decrease the loop, and a third control to select the third drive mode after the loop reaches a predetermined amount, to lower a velocity of clearing the loop from a velocity of clearing the loop of the second control; and wherein the processor repeats an operation of selecting the third control for a fixed period of time followed by selecting the second control until the loop clearance is confirmed.

2. The sheet conveyor according to claim 1, further comprising a sensor for detecting whether the sheet loop reaches the predetermined amount or not;

wherein the processor switches from the second control to the third control in response to the sensor detecting the sheet loop reaching the predetermined amount.

3. An image forming apparatus comprising a sheet conveyor, the sheet conveyor comprising:

a first roller pair including a roller to which a torque limit of a torque limiter is imparted;

a second roller pair disposed downstream of the first roller pair in a sheet conveyance direction;

a drive shaft;

motors that drive the drive shaft and the second roller pair;

first and second electromagnetic clutches configured to be selectively engaged to couple the drive shaft to the first roller pair and selectively transmit torque to rotate the first roller pair;

a processor causing, in a first drive mode, the first roller pair to be coupled to the drive shaft through a first transmission mechanism using the first electromagnetic clutch so as to rotate at a higher peripheral velocity than a peripheral velocity of the second roller pair, in a second drive mode, the second roller pair is kept rotating whereas the first roller pair is not driven, and in a third drive mode, the first roller pair is coupled to the drive shaft through a second transmission mechanism using the second electromagnetic clutch so as to rotate at a lower peripheral velocity than a peripheral velocity of the second roller pair;

the processor providing a first control to select the first drive mode to allow the sheet to form a loop between the first roller pair and the second roller pair, a second control to select the second drive mode to decrease the loop, and a third control to select the third drive mode after the loop reaches a predetermined amount, to lower a velocity of clearing the loop from a velocity of clearing the loop of the second control; and wherein the processor repeats an operation of selecting the third control for a fixed period of time followed by selecting the second control until the loop clearance is confirmed.

4. The image forming apparatus according to claim 3, further comprising a sensor for detecting whether the sheet loop reaches the predetermined amount or not;

wherein the processor switches from the second control to the third control in response to the sensor detecting the sheet loop reaching the predetermined amount.

5. An image scanning apparatus comprising a sheet conveyor, the sheet conveyor comprising:

a first roller pair including a roller to which a torque limit of a torque limiter is imparted;

a second roller pair disposed downstream of the first roller pair in a sheet conveyance direction;

a drive shaft;

motors that drive the drive shaft and the second roller pair;

first and second electromagnetic clutches configured to be selectively engaged to couple the drive shaft to the first roller pair and selectively transmit torque to rotate the first roller pair;

a processor causing, in a first drive mode, the first roller pair to be coupled to the drive shaft through a first transmission mechanism using the first electromagnetic clutch so as to rotate at a higher peripheral velocity than a peripheral velocity of the second roller pair, in a second drive mode, the second roller pair is kept rotating whereas the first roller pair is not driven, and in a third drive mode, the first roller pair is coupled to the drive shaft through a second transmission mechanism using the second electromagnetic clutch so as to rotate at a lower peripheral velocity than a peripheral velocity of the second roller pair;

the processor providing a first control to select the first drive mode to allow the sheet to form a loop between the first roller pair and the second roller pair, a second control to select the second drive mode to decrease the loop, and a third control to select the third drive mode after the loop reaches a predetermined amount, to lower a velocity of clearing the loop from a velocity of clearing the loop of the second control; and wherein the processor repeats an operation of selecting the third control for a fixed period of time followed by selecting the second control until the loop clearance is confirmed.

6. The image scanning apparatus according to claim 5, further comprising a sensor for detecting whether the sheet loop reaches the predetermined amount or not;

wherein the processor switches from the second control to the third control in response to the sensor detecting the sheet loop reaching the predetermined amount.

* * * * *